US006058691A

United States Patent [19]

Greeves

[11] Patent Number: 6,058,691

[45] Date of Patent: May 9, 2000

[54] RAKE HEAD ATTACHMENT

[76] Inventor: Martin John Greeves, 47 Belfast Road, Antrim, UK, BT41 1PB, United Kingdom

[21] Appl. No.: 09/090,133

[22] Filed: Jun. 4, 1998

[51] Int. Cl.[7] ..... A01D 7/00

[52] U.S. Cl. ..... 56/400.19; 56/400.04

[58] Field of Search ..... 56/400.01, 400.04, 56/400.17, 400.19, DIG. 7; 294/19.2; 33/372, 373, 370, 371; 473/201

[56] References Cited

U.S. PATENT DOCUMENTS

| | | | |
|---|---|---|---|
| 2,624,118 | 1/1953 | Anderson | 33/89 |
| 2,677,192 | 5/1954 | Anderson | 33/207 |
| 2,721,755 | 10/1955 | Walner | 294/19 |
| 3,437,339 | 4/1969 | Starck | 273/138 |
| 3,870,300 | 3/1975 | Amendola | 273/32 |
| 4,216,831 | 8/1980 | Ritchie | 172/380 |
| 4,871,029 | 10/1989 | Rosin | 172/378 |
| 5,012,872 | 5/1991 | Cohn | 172/380 |
| 5,080,413 | 1/1992 | Vobeda | 294/19.2 |

*Primary Examiner*—Thomas B. Will
*Assistant Examiner*—Meredith C Petravick

[57] ABSTRACT

A rake head attachment for being removably attached to the shaft of a golf club. The device includes a pair of elongate blade members each having a notch portion and a plurality of substantially parallel rake teeth being extended from each elongate blade member. The elongate blade member are attached to each other so that their notch portions form a shaft notch for accepting a shaft of a golf club. A handle portion is extended from each of the elongate blade members and are positioned adjacent to each other. A spring is positioned between the handle portions to bias the notch portions towards each other into a pinching position so that a shaft accepted within the shaft notch is pinched by the notch portions thereby attaching the elongate blade members to the shaft.

5 Claims, 4 Drawing Sheets

RAKE HEAD ATTACHMENT

BACKGROUND OF THE INVENTION

1. Field of the Invention

The present invention relates to rake head attachments and more particularly pertains to a new rake head attachment for being removably attached to the shaft of a golf club.

2. Description of the Prior Art

The use of rake head attachments is known in the prior art. More specifically, rake head attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art rake head attachments include U.S. Pat. No. 5,230,385; U.S. Pat. No. 5,110,168; U.S. Pat. No. 4,871,029; U.S. Pat. No. 4,216,831; U.S. Pat. No. 5,094,456; and U.S. Pat. No. 4,774,804.

While these devices fulfill their respective, particular objectives and requirements, the aforementioned patents do not disclose a new rake head attachment. The inventive device includes a pair of elongate blade members each having a notch portion and a plurality of substantially parallel rake teeth being extended from each elongate blade member. The elongate blade member are attached to each other so that their notch portions form a shaft notch for accepting a shaft of a golf club. A handle portion is extended from each of the elongate blade members and are positioned adjacent to each other. A spring is positioned between the handle portions to function as a biasing means for biasing the notch portions towards each other into a pinching position so that a shaft accepted within the shaft notch is pinched by the notch portions thereby attaching the elongate blade members to the shaft.

In these respects, the rake head attachment according to the present invention substantially departs from the conventional concepts and designs of the prior art, and in so doing provides an apparatus primarily developed for the purpose of being removably attached to the shaft of a golf club.

SUMMARY OF THE INVENTION

In view of the foregoing disadvantages inherent in the known types of rake head attachments now present in the prior art, the present invention provides a new rake head attachment construction wherein the same can be utilized for being removably attached to the shaft of a golf club.

The general purpose of the present invention, which will be described subsequently in greater detail, is to provide a new rake head attachment apparatus and method which has many of the advantages of the rake head attachments mentioned heretofore and many novel features that result in a new rake head attachment which is not anticipated, rendered obvious, suggested, or even implied by any of the prior art rake head attachments, either alone or in any combination thereof.

To attain this, the present invention generally comprises a pair of elongate blade members each having a notch portion and a plurality of substantially parallel rake teeth being extended from each elongate blade member. The elongate blade member are attached to each other so that their notch portions form a shaft notch for accepting a shaft of a golf club. A handle portion is extended from each of the elongate blade members and are positioned adjacent to each other. A spring is positioned between the handle portions to function as a biasing means for biasing the notch portions towards each other into a pinching position so that a shaft accepted within the shaft notch is pinched by the notch portions thereby attaching the elongate blade members to the shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rake head attachment apparatus and method which has many of the advantages of the rake head attachments mentioned heretofore and many novel features that result in a new rake head attachment which is not anticipated, rendered obvious, suggested, or even implied by any of the prior art rake head attachments, either alone or in any combination thereof.

It is another object of the present invention to provide a new rake head attachment which may be easily and efficiently manufactured and marketed.

It is a further object of the present invention to provide a new rake head attachment which is of a durable and reliable construction.

An even further object of the present invention is to provide a new rake head attachment which is susceptible of a low cost of manufacture with regard to both materials and labor, and which accordingly is then susceptible of low prices of sale to the consuming public, thereby making such rake head attachment economically available to the buying public.

Still yet another object of the present invention is to provide a new rake head attachment which provides in the apparatuses and methods of the prior art some of the advantages thereof, while simultaneously overcoming some of the disadvantages normally associated therewith.

Still another object of the present invention is to provide a new rake head attachment for being removably attached to the shaft of a golf club.

Yet another object of the present invention is to provide a new rake head attachment which includes a pair of elongate blade members each having a notch portion and a plurality of substantially parallel rake teeth being extended from each elongate blade member. The elongate blade member are attached to each other so that their notch portions form a shaft notch for accepting a shaft of a golf club. A handle portion is extended from each of the elongate blade members and are positioned adjacent to each other. A spring is positioned between the handle portions to function as a biasing means for biasing the notch portions towards each other into a pinching position so that a shaft accepted within the shaft notch is pinched by the notch portions thereby attaching the elongate blade members to the shaft.

Still yet another object of the present invention is to provide a new rake head attachment that is collapsible for easy storage.

Even still another object of the present invention is to provide a new rake head attachment that may be easily attached and removed from a golf club.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
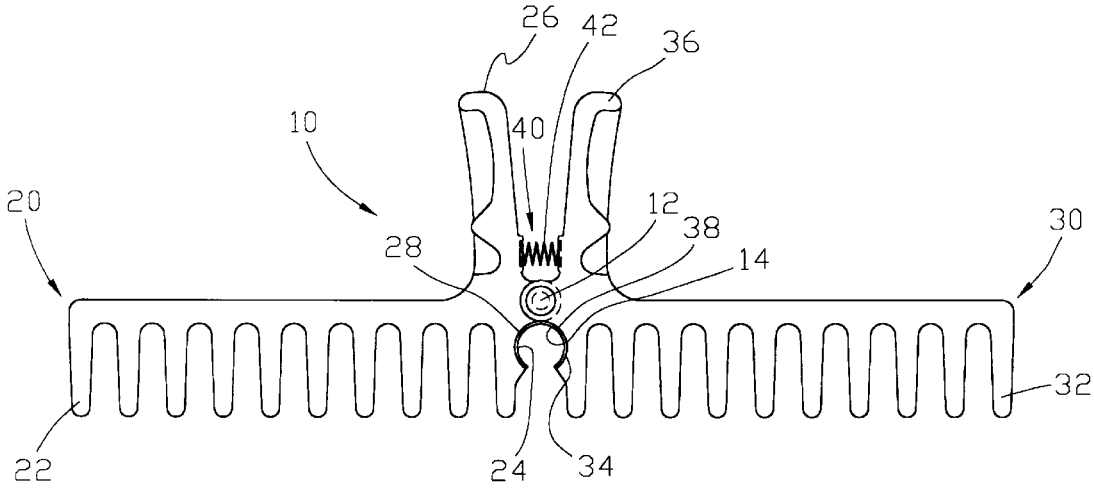
FIG. 1 is a schematic top plan view of a new rake head attachment according to the present invention.
Figure 2:
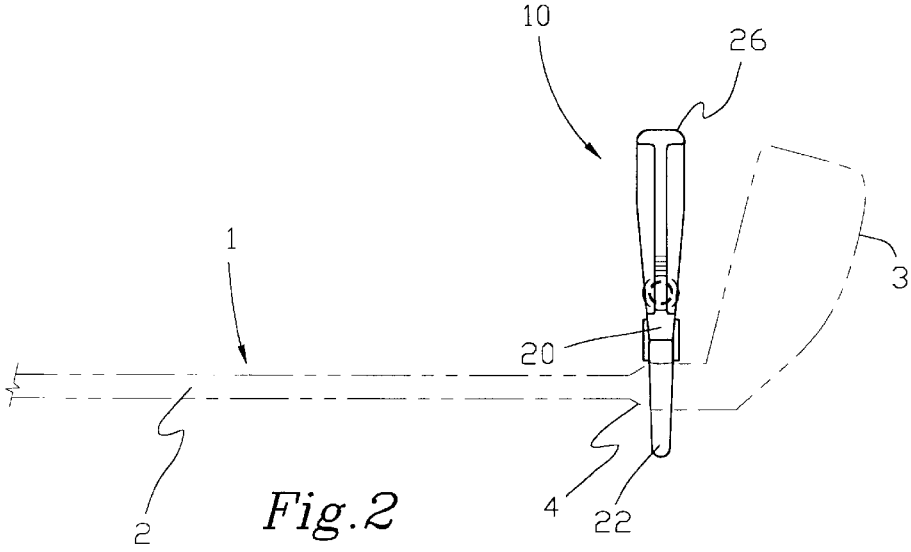
FIG. 2 is a schematic side view of the present invention attached to the neck or hosel portion of a golf club.

With reference now to the drawings, and in particular to FIGS. 1 through 10 thereof, a new rake head attachment embodying the principles and concepts of the present invention and generally designated by the reference numeral 10 will be described.

As best illustrated in FIGS. 1 through 10, the rake head attachment 10 is designed for removable attachment to a shaft 2 of a golf club 1 and generally comprises a first elongate blade member 20 and a second elongate blade member 30.

The first elongate blade member 20 has a plurality of substantially parallel rake teeth 22 extending from it. Preferably, the rake teeth 22 are extended substantially perpendicularly outwards from the first elongate blade member 20. Similarly, the second elongate blade member 30 also has a plurality of substantially parallel rake teeth 32 extending from it. Preferably, the rake teeth 32 are extended substantially perpendicularly outwards from the second elongate blade member 30. The second elongate blade member 30 is coupled to the first elongate blade member 20. Preferably, the second elongate blade member 30 is coupled to the first elongate blade member 20 by a fastener 12 such as a rivet, pin, or screw. The blade members are attached to each other so that the first elongate blade member 20 is in substantially parallel alignment with the second elongate blade member 30. Preferably, the first elongate blade member 20 is in substantially linear alignment with the second elongate blade member 30.

Figure 3:
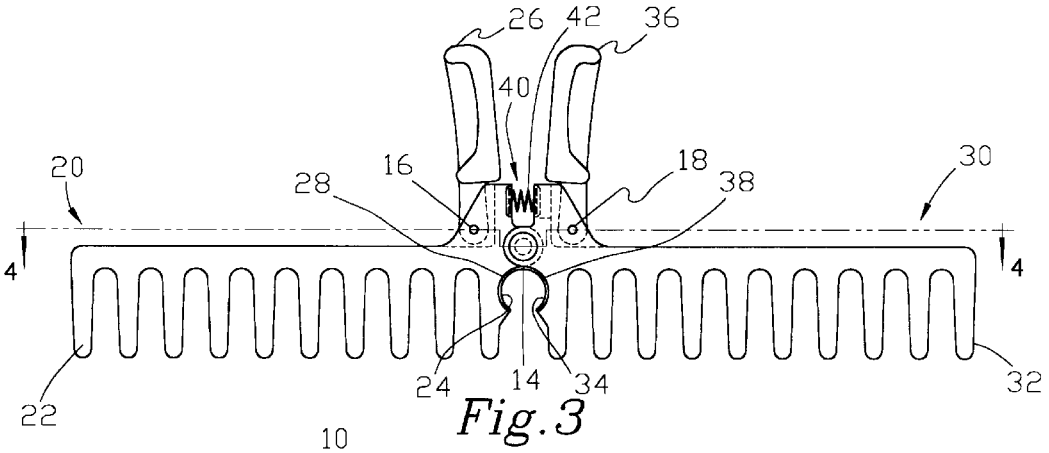
FIG. 3 is a schematic top plan view of a collapsible embodiment of the present invention in the extended position.
Figure 4:
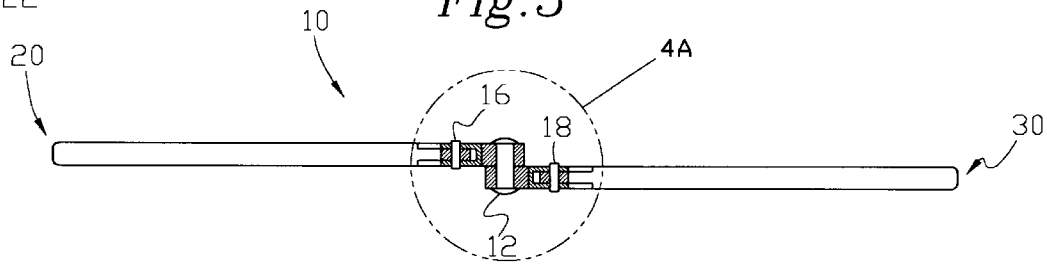
FIG. 4 is a schematic side view of the collapsible embodiment of the present invention in the extended position.
Figure 4A:
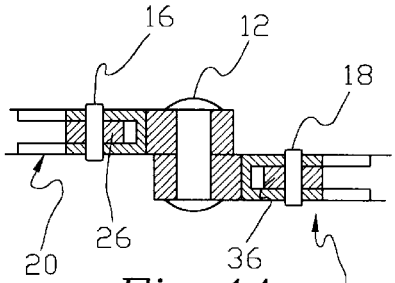
FIG. 4A is a schematic sectional side view of the collapsible embodiment of the present invention taken from circle 4 on FIG. 4.
Figure 5:
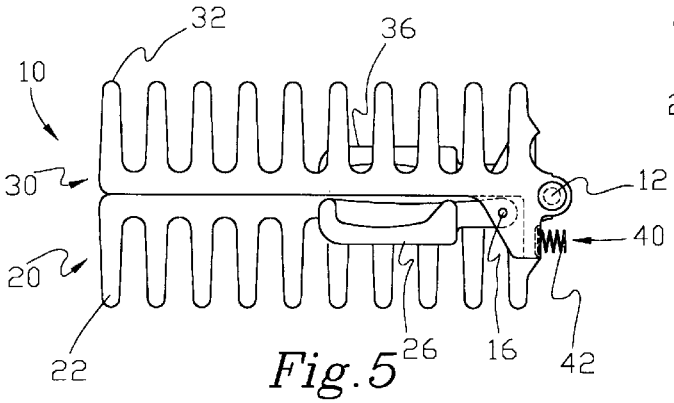
FIG. 5 is a schematic top plan view of the collapsible embodiment of the present invention in the collapsed position.
Figure 6:
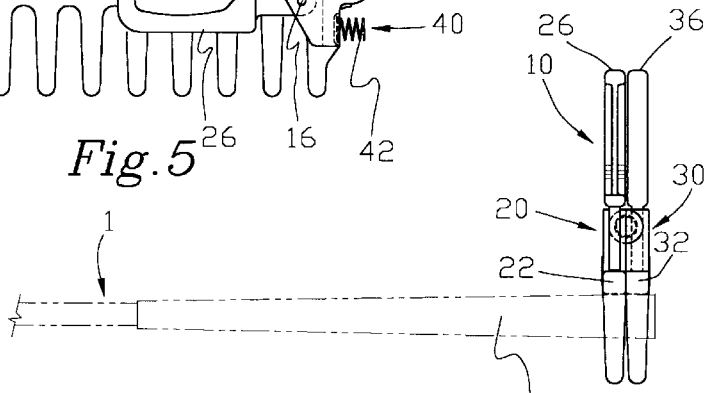
FIG. 6 is a schematic side view of the collapsible embodiment attached on the handle portion of the golf club shaft.
Figure 7:
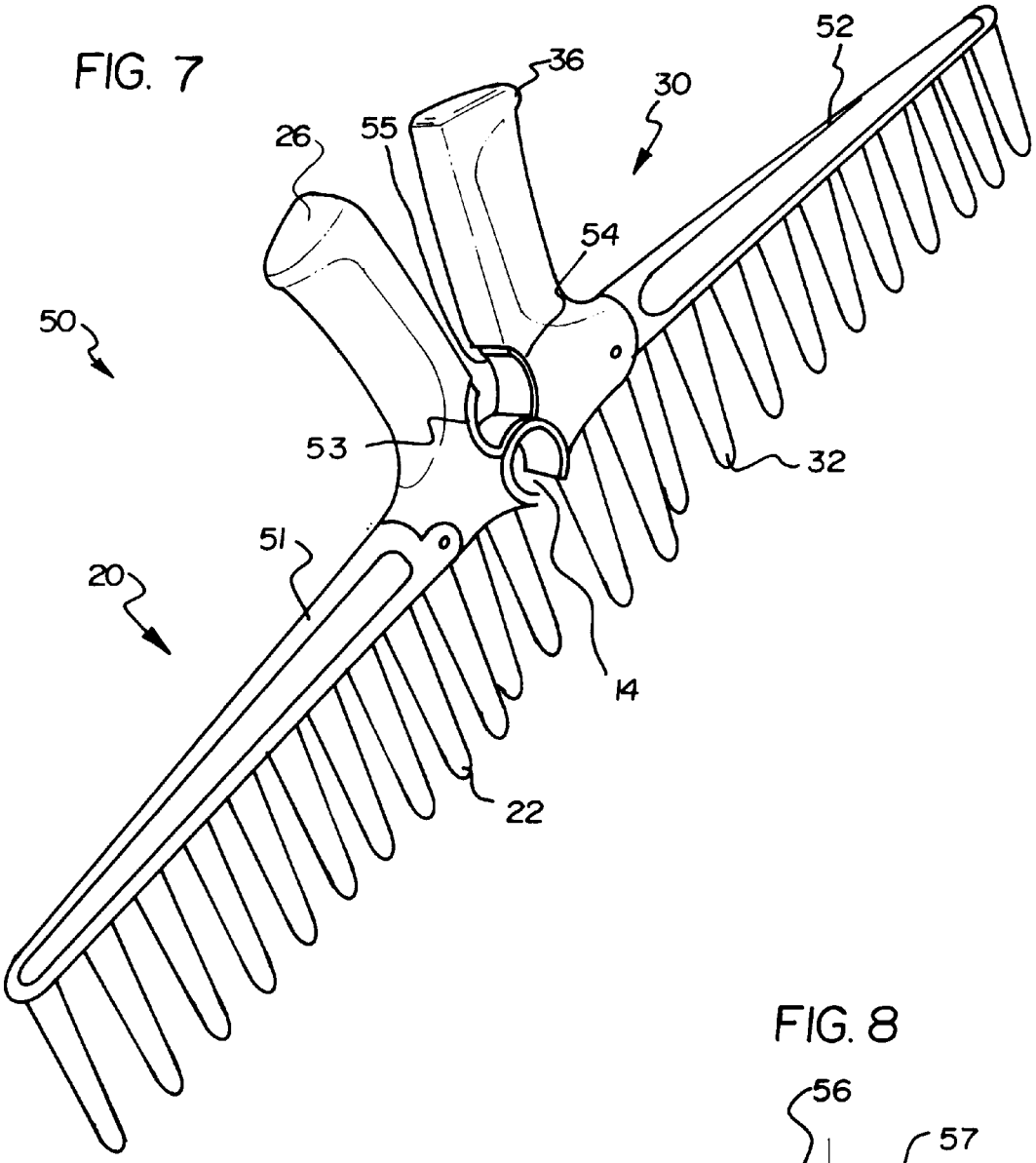
FIG. 7 is a schematic perspective view of an additional ideal embodiment of the present invention in the extended position.
Figure 8:
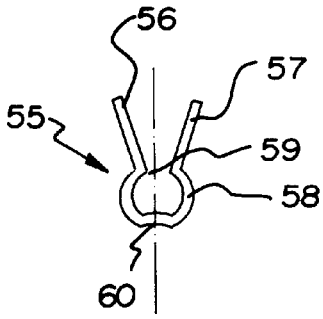
FIG. 8 is a schematic side view of the spring clip of the additional ideal embodiment of the present invention.

Optionally, the first elongate blade member 20 and the second elongate blade member 30 may be rotatable between a collapsed position and an extended position. FIG. 5 shows the first elongate blade member 20 and the second elongate blade member 30 in the collapsed position. The collapsed position allows a user to conveniently store the rake head attachment 10 when not in use. The extended position is shown in FIG. 3. In the extended position, the first elongate blade member 20 is in a substantially linear alignment with the second elongate blade member 30.

The first elongate blade member 20 also includes a first notch portion 24. The second elongate blade member 30 also includes a corresponding second notch portion 34. The second notch portion 34 is positioned adjacent the first notch portion 24 so that they form a shaft notch 14. The shaft notch 14 is designed to accept the shaft 2 of the golf club 1 through it.

The invention also includes a first handle portion 26 and a second handle portion 36. The first handle portion 26 is extended from the first elongate blade member 20 and the second handle portion 36 is extended from the second elongate blade member 30. Preferably, the first handle portion 26 is in substantially perpendicular alignment with the first elongate blade member 20 and the second handle portion 36 is in substantially perpendicular alignment with the second elongate blade member 30. The second handle portion 36 is positioned adjacent the first handle portion 26.

Optionally, the first handle portion 26 and the second handle portion 36 are each rotatable between a collapsed position and an extended position. Preferably, in such an option, the handle portions 26,36 are attached to their respective elongate blade members 20,30 by a fastener 16,18 that permits rotation of the handle members 26,36. As shown in FIG. 5, the first handle portion 26 is in a substantially parallel alignment with the first elongate blade member 20 when the first handle portion 26 is in the collapsed position. Similarly, the second handle portion 36 is in a substantially parallel alignment with the second elongate blade member 30 when the second handle portion 36 is in the collapsed position. When in the extended position, the first handle portion 26 is substantially perpendicular aligned to the first elongate blade member 20 and the second handle portion 36 is substantially perpendicular aligned to the second elongate blade member 30.

The rake head attachment also includes a biasing means 40 for biasing the first notch portion 24 towards the second notch portion 34 into a pinching position. The function of the pinching position is for pinching the shaft 2 that is accepted within the shaft notch 14. This permits the first elongate blade member 20 and the second elongate blade member 30 to be attached to the shaft 2. Preferably, the biasing means 40 is a spring 42 positioned between the first handle portion 26 and the second handle portion 36 so that the spring biases the first notch portion 24 towards the second notch portion 34 into the pinching position. Optionally, the notch portions 24,34 may be covered by a soft material 28,38 such as rubber to insure that the shaft 2 is firmly held in position within the shaft notch 14 when pinched by the notch portions 24,34.

In use, the rake head attachment 10 may be attached on the shaft 2 either at the handle portion end or at the neck or hosel portion 4 of the head end 3 of a golf club.

Figure 9:
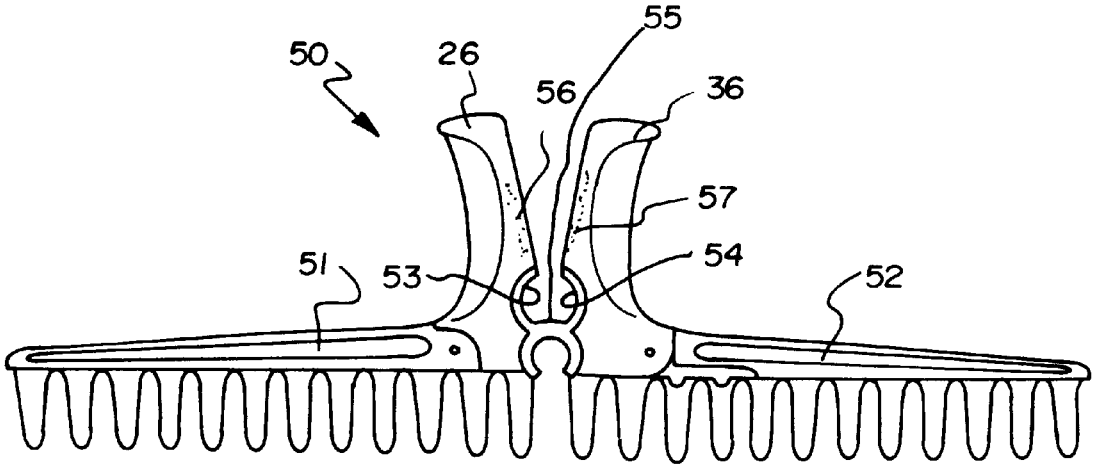
FIG. 9 is a schematic side view of the additional ideal embodiment of the present invention in the extended position.
Figure 10:
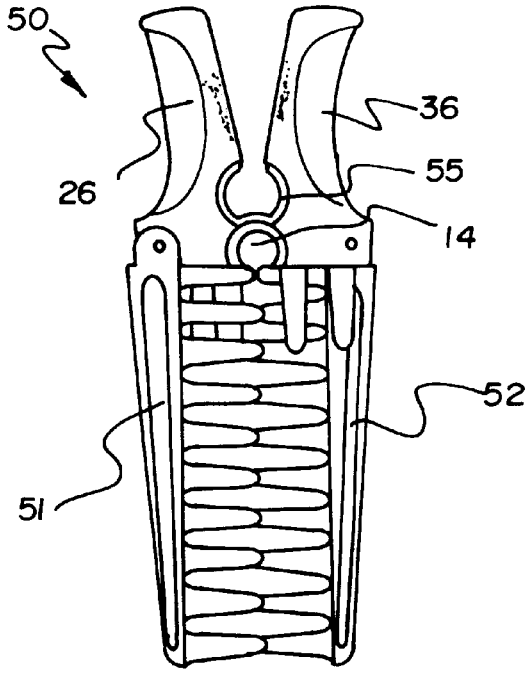
FIG. 10 is a schematic side view of the additional ideal embodiment in the collapsed position.

FIGS. 7 through 10 illustrate another ideal embodiment 50 of the rake head attachment. In this embodiment 50, each of the blade members includes a body portion 51,52 which are pivotally coupled to the handle portion of their respective blade member so that, as illustrated in FIG. 10, the body portions 51,52 may be easily folded together into a collapsed position when the rake head attachment is not in use. In this embodiment, preferably most of the rake teeth 22 of each of the blade members extends from the body portion of the blade member. Additionally, the handle portion 26,36 of each blade member has an arcuate concave region 53,54 positioned adjacent the notch portion of the blade member.

Like the other embodiments, the notch portions of the blade members are positioned adjacent each other so that they forming the a shaft notch therebetween. The first and second arcuate concave regions 53,54 are positioned adjacent each other such that the concavities of the first and second arcuate concave regions face each other.

This embodiment, also includes a resiliently deflectable spring clip 55 having a generally C-shaped main portion 58 and a pair of opposing elongate end portions 56,57 outwardly extending from the ends of the main portion 58 of the spring clip 55. The main portion 58 of the spring clip has a break 59 defined between the end portions 56,57 of the spring clip 55. Preferably, the main portion 58 of the spring clip also has a convex region 60 positioned opposite the break 59 of the spring clip 55.

As illustrated in FIG. 9, the first end portion 56 of the spring clip is inserted into the first handle portion 26 while the second end portion 57 of the spring clip is inserted into the second handle portion 36 such that the spring clip 55 connects the first and second blade members 20,30 together. The main portion 55 is interposed between the first and second arcuate concave regions 53,54 of the first and second blade members preferably with the convex region 60 of the main portion of the spring clip is positioned adjacent the first and second notch portions 24,34. The spring clip 55 biases the first notch portion 24 towards the second notch portion 34 into the pinching position to pinch a shaft 2 of a golf club received in the shaft notch so that the first elongate blade member and the second elongate blade member are attached to the shaft.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rake head attachment for removable attachment to a shaft of a golf club, said rake head attachment comprising:

a first elongate blade member having a first notch portion and a plurality of substantially parallel rake teeth and, said rake teeth being extended from said first elongate blade member;

a second elongate blade member having a second notch portion and a plurality of substantially parallel rake teeth, said rake teeth being extended from said second elongate blade member, said second elongate blade member being coupled to said first elongate blade member, said second notch portion being positioned adjacent said first notch portion, said first notch portion and said second notch portion forming a shaft notch, said shaft notch being for accepting a shaft of a golf club therethrough;

a first handle portion being extended from said first elongate blade member;

a second handle portion being extended from said second elongate blade member, said second handle portion being positioned adjacent said first handle portion; and a biasing means for biasing said first notch portion towards said second notch portion into a pinching position, said pinching position being for pinching a shaft being accepted within said shaft notch whereby said first elongate blade member and said second elongate blade member are attached to the shaft;

wherein said biasing means is a spring being positioned between said first handle portion and said second handle portion, said spring biasing said first notch portion towards said second notch portion into said pinching position;

wherein said first elongate blade member is in substantially parallel alignment with said second elongate blade member;

wherein said rake teeth of said first elongate blade member are extended substantially perpendicularly outward from said first elongate blade member, and wherein said rake teeth of said second elongate blade member arc extended substantially perpendicularly outward from said second elongate blade member;

wherein said first elongate blade member and said second elongate blade member are rotatable between a collapsed position and an extended position;

wherein said first elongate blade member is in substantially linear alignment with said second elongate blade member when said first elongate blade member and said second elongate blade member are in said extended position; and wherein said first handle portion is rotatable between a collapsed position and an extended position and wherein said second handle portion is rotatable between a collapsed position and an extended position.

2. The rake head attachment of claim 1, wherein said first handle portion is in substantially parallel alignment with said first elongate blade member when said first handle portion is in said collapsed position, and wherein said second handle portion is in substantially parallel alignment with said second elongate blade member when said second handle portion is in said collapsed position.

3. The rake head attachment of claim 1, wherein said first handle portion is in substantially perpendicular alignment with said first elongate blade member when said first handle portion is in said extended position, and wherein said second handle portion is in substantially perpendicular alignment with said second elongate blade member when said second handle portion is in said extended position.

4. The rake head attachment of claim 1, wherein said first handle portion is in substantially perpendicular alignment with said first elongate blade member and wherein said second handle portion is in substantially perpendicular alignment with said second elongate blade member.

5. A rake head attachment for removable attachment to a shaft of a golf club, said rake head attachment comprising:

a first elongate blade member having a first body portion, a first handle portion, and a first notch portion;

said first body portion being pivotally coupled to said first handle portion, said first body portion having a plurality of substantially parallel rake teeth, said rake teeth being extended substantially perpendicularly outward from said first body member;

said first handle portion having a first arcuate concave region, said first arcuate concave portion being positioned adjacent said first notch portion;

a second elongate blade member having a second body portion, a second handle portion, and a second notch portion;

said second body portion being pivotally coupled to said second handle portion, said second body portion having a plurality of substantially parallel rake teeth, said rake teeth being extended substantially perpendicularly outward from said second body member;

said second handle portion having a second arcuate concave region, said second arcuate concave portion being positioned adjacent said second notch portion;

said second notch portion being positioned adjacent said first notch portion, said first notch portion and said second notch portion forming a shaft notch, said shaft notch being for accepting a shaft of a golf club therethrough;

said first and second arcuate concave regions being positioned adjacent each other such that the concavities of said first and second arcuate concave regions face each other;

said first and second blade members each lying in a plane, said planes of said first and second blade members being coplanar;

a resiliently deflectable spring clip having a generally C-shaped main portion and a pair of opposing elongate end portions;

said main portion of said spring clip having a break defined between said end portions of said spring clip, said main portion of said spring clip having a convex region positioned opposite said break of said spring clip;

said first end portion of said spring clip being inserted into said first handle portion, said second end portion of said spring clip being inserted into said second handle portion, said main portion being interposed between said first and second arcuate concave regions of said first and second blade members, said convex region of said main portion of said spring clip being positioned adjacent said first and second notch portions; and said spring clip biasing said first notch portion towards said second notch portion into a pinching position, said pinching position being for pinching a shaft being accepted within said shaft notch whereby said first elongate blade member and said second elongate blade member are attached to the shaft.

* * * * *